US005152518A

United States Patent [19]

Kikuchi et al.

[11] Patent Number: 5,152,518

[45] Date of Patent: Oct. 6, 1992

[54] METHOD OF CONTROLLING AN AUTOMATIC SHEET FEEDER USING MULTIPLE PULSES

[75] Inventors: Hiroshi Kikuchi; Jiro Tanuma; Takao Uchida; Akira Nagumo, all of Tokyo, Japan

[73] Assignee: Oki Electric Industry Co., Ltd., Tokyo, Japan

[21] Appl. No.: 476,441

[22] PCT Filed: Oct. 4, 1989

[86] PCT No.: PCT/JP89/01012

§ 371 Date: Feb. 14, 1991

§ 102(e) Date: Feb. 14, 1991

[87] PCT Pub. No.: WO90/03937

PCT Pub. Date: Apr. 19, 1990

[30] Foreign Application Priority Data

Oct. 5, 1988 [JP] Japan ..... 63-249793

[51] Int. Cl.[5] ..... B65H 3/44; B65H 5/26

[52] U.S. Cl. ..... 271/9; 400/605

[58] Field of Search ..... 271/9; 400/605

[56] References Cited

U.S. PATENT DOCUMENTS

| | | | |
|---|---|---|---|
| 4,265,440 | 5/1981 | Shibazaki | 271/9 |
| 4,663,722 | 5/1987 | Sato | 271/9 |
| 4,804,997 | 2/1989 | Mizude et al. | 271/9 |
| 4,809,050 | 2/1989 | Ito | 271/9 |
| 4,908,672 | 3/1990 | Ito | 271/9 |
| 5,033,890 | 7/1991 | Niikawa | 271/9 |

FOREIGN PATENT DOCUMENTS

| | | | |
|---|---|---|---|
| 54-42149 | 4/1979 | Japan . | |
| 58-69686 | 4/1983 | Japan . | |
| 59-50692 | 3/1984 | Japan . | |
| 61-183036 | 8/1986 | Japan . | |
| 79141 | 4/1987 | Japan | 271/9 |
| 37949 | 2/1988 | Japan | 271/9 |
| 2221451 | 2/1990 | United Kingdom | 271/9 |

*Primary Examiner*—Robert P. Olszewski
*Assistant Examiner*—Steven M. Reiss
*Attorney, Agent, or Firm*—Wenderoth, Lind & Ponack

[57] ABSTRACT

The operation of an automatic sheet feeder provided with a plurality of sheet hoppers which are used selectively to feed sheets to a printer is controlled. A control unit of the printer supplies a multiplex control signal including a hopper select signal and a sheet delivery signal to the automatic sheet feeder through a single signal line. The width of pulses of the hopper select signal is smaller than a predetermined time, while the width of the sheet delivery signal is greater than the predetermiend time. The pulses of the multiplex control signal are compared with the predetermined time to discriminate the hopper select signal and the sheet delivery signal from each other. That sheet hopper corresponding to the number of pulses of the hopper select signal is selected, and then the automatic feeding of sheets from the selected sheet hopper commences upon the reception of the sheet delivery signal.

7 Claims, 5 Drawing Sheets

METHOD OF CONTROLLING AN AUTOMATIC SHEET FEEDER USING MULTIPLE PULSES

BACKGROUND OF THE INVENTION

The present invention relates to a method of controlling an automatic sheet feeder installed on an impact printer and, more particularly, to a method of controlling an automatic sheet feeder having a plurality of sheet hoppers to change feeding from the sheet hoppers automatically.

An automatic sheet feeder installed on an impact printer feeds sheets one at a time to the impact printer. When changing sheets having one width for sheets having a different width on such an automatic sheet feeder, the positions of sheet guides provided on a sheet hopper must be adjusted according to the width of the sheets. A recently developed automatic sheet feeder is provided with a plurality of sheet hoppers respectively containing sheets of different widths to feed selected sheets from the sheet hoppers.

FIG. 6 is a time chart showing the operation of an automatic sheet feeder provided with two sheet hoppers (hereinafter, referred to as a "dual hopper automatic sheet feeder") typical of conventional automatic sheet feeders provided with a plurality of sheet hoppers. A printer transmits a sheet hopper select signal 51 to the automatic sheet feeder for selecting either sheet hopper. A sheet delivery signal 52 commands the operation of a delivery roller, namely, a signal to drive a stepping motor provided in the automatic sheet feeder. Upon the reception of the sheet delivery signal 52, the automatic sheet feeder selects that sheet hopper corresponding to the hopper select signal 51, and drives the stepping motor to rotate the delivery roller for feeding a sheet from the selected sheet hopper to the printer.

Upon the detection of the sheet by a detector, not shown, the printer transmits a signal to the automatic sheet feeder to stop the sheet feeding operation, and then the automatic sheet feeder stops the stepping motor, thus stopping the sheet feeding operation. Indicated at 53 is a graph or line representing the sheet feeding speed of the automatic sheet feeder.

When a sheet feed command is given in a situation where the hopper select signal is not transmitted properly from the printer to the automatic sheet feeder, the sheet hopper specified previously and stored in the automatic sheet feeder is selected when the sheet feed command is given immediately after the automatic sheet feeder has been connected to a power source or the sheet hopper selected by the preceding hopper select command becomes active when the sheet feed command is given during operation.

This control method, however, requires one signal line for transmitting the hopper select signal 51 for selecting either sheet hopper, and another signal line for transmitting the sheet delivery signal 52 requesting feeding of a sheet. Once a host computer for controlling the printer has given a command for an initial resetting, the printer is unable to send a new hopper select signal to the automatic sheet feeder and, in some cases, the automatic sheet feeder selects the wrong sheet hopper.

SUMMARY OF THE INVENTION

The present invention provides a method of controlling a dual hopper automatic sheet feeder, whereby it is possible to solve problems resulting from the use of one signal line for sheet hopper selection and another signal line for starting sheet feeding, and wherein control of a sheet feeding operation is achieved by using a single signal line.

The method of the present invention for controlling an automatic sheet feeder provided with a plurality of sheet hoppers which are used selectively to feed sheets to a printer provides that a hopper select signal and a sheet deliver signal are transmitted through a single signal line from the printer to the automatic sheet feeder. The pulse width of the hopper select signal is smaller than that of the sheet delivery signal. The hopper select signal having a smaller pulse width is transmitted to the automatic sheet feeder to select the sheet hopper corresponding to the number of pulses of the hopper select signal. A stepping motor is driven to feed a sheet when the sheet delivery signal is transmitted to the automatic sheet feeder after the sheet hopper has been selected.

Since the sheet hopper can be selected and sheet feed operation can be started by signals transmitted through a single signal line, the cost of the control system is reduced and the automatic sheet feeder itself will be less expensive.

Furthermore, in executing an initial setting in response to a command given by a host computer for controlling the printer after the hopper select signal has been supplied to the automatic sheet feeder, the sheet delivery signal can be canceled by transmitting a hopper select signal for selecting a new sheet hopper from the printer to the automatic sheet feeder. Hence, an incorrect selection of a sheet hopper is obviated and correct operation can be expected.

DETAILED DESCRIPTION OF THE INVENTION

Figure 1:
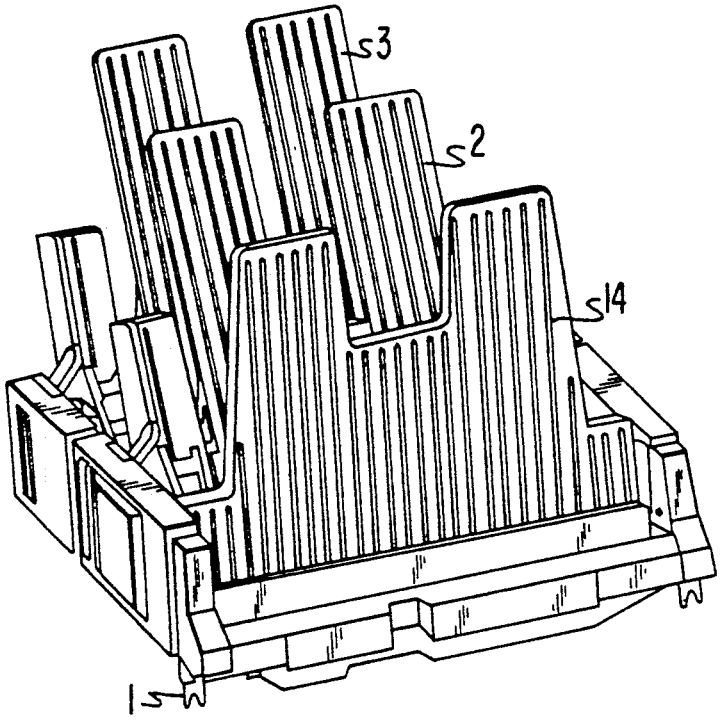
FIG. 1 is a perspective view of an automatic sheet feeder embodying the present invention.
Figure 2:
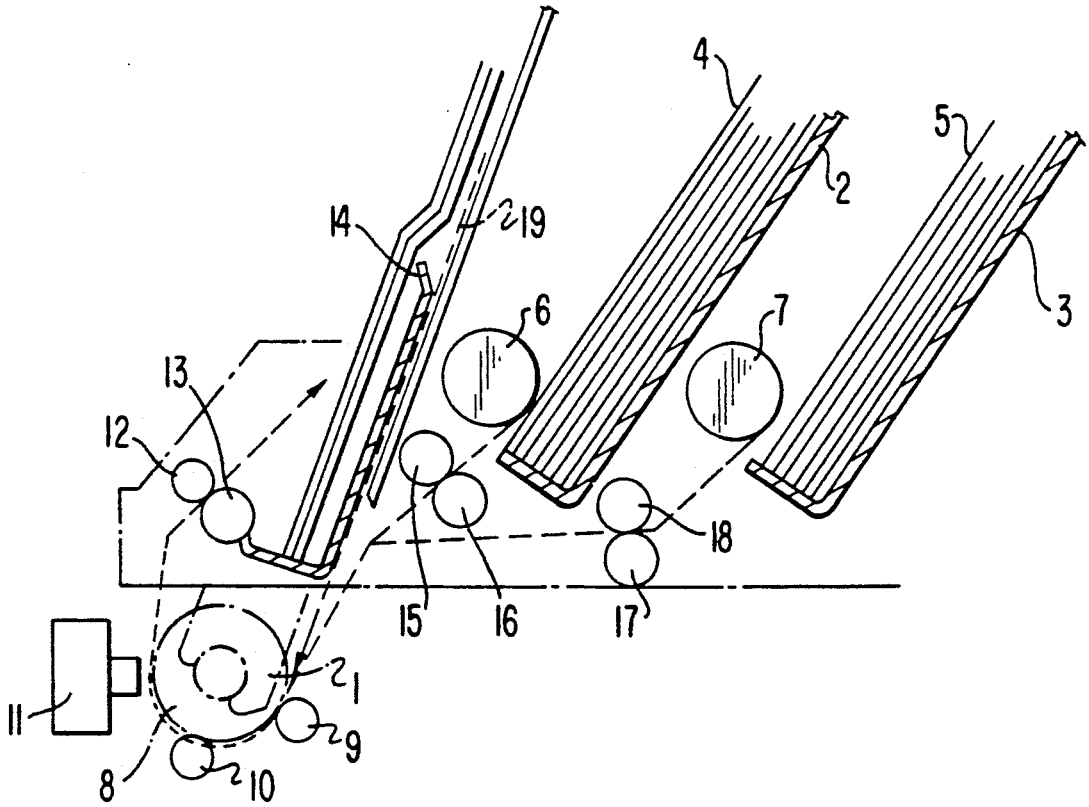
FIG. 2 is a sectional view of the automatic sheet feeder of the present invention.

FIGS. 1 and 2 are a perspective view and a sectional view, respectively, of an automatic sheet feeder embodying the present invention. Referring to FIGS. 1 and 2, indicated at 1 are connecting lugs for connecting the automatic sheet feeder to a printer, at 2 is a sheet hopper for holding a stack of sheets for printing, and at 3 is another sheet hopper similar to the sheet hopper 2. The sheet hoppers 2 and 3 may hold the same types or different types of sheets.

The sheet hoppers 2 and 3 are provided with respective delivery rollers 6 and 7 for feeding respective sheets 4 and 5 held therein one sheet at a time. The delivery rollers 6 and 7 are interlocked through a one-way clutch, not shown, with a stepping motor. Either of the delivery rollers 6 or 7, depending on the direction of rotation of the stepping motor, is driven.

The sheet 4 or 5 delivered from the sheet hopper 2 or 3 in response to a control signal given by the printer is held between a platen 8 and clamping rollers 9 and 10 pressed toward the platen 8 and is fed as the platen 8 rotates. A print head 11 strikes, through an ink ribbon, the sheet 4 or 5 pressed against the platen 8, thereby achieving printing. Then, the sheet 4 or 5 is delivered by rollers 12 and 13 that are pressed toward each other to a stacker 14.

Rollers 15 and 16 or rollers 17 and 18 operate in synchronism with the rotation of the plate g and are provided to deliver the sheet 4 or 5 delivered by the delivery roller 6 or 7 to the platen g in synchronism with the operation of the print head 11. The automatic sheet feeder also is provided with a hand feed slit 19 for manual sheet feed.

Figure 3:
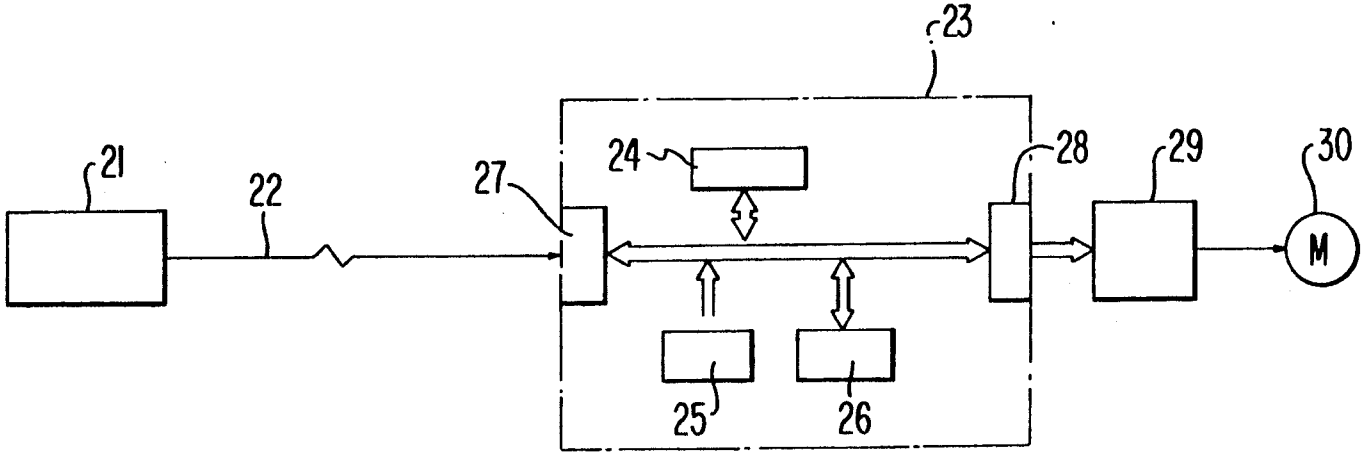
FIG. 3 is a block diagram of the automatic sheet feeder of the present invention.

FIG. 3 is a block diagram of the automatic sheet feeder of the present invention. Referring to FIG. 3, a control unit 21 of the printer is connected to a control circuit 23 in the form of a one-chip microcontroller of the automatic sheet feeder by an interface signal line 22. The control circuit 23 comprises a CPU 24, a ROM 25 storing programs, a RAM 26 for storing data and results of intermediate calculations, an I/O port 27 for exchanging therethrough control signals with the printer, and an I/O port 28 for exchanging therethrough control signals with a stepping motor driving circuit 29. The stepping motor driving circuit 29 drives a stepping motor 30 for driving the delivery roller 6 and 7 to deliver the sheets one by one from the sheet hoppers 2 and 3.

A method of controlling the automatic sheet feeder of the present invention will be described hereinafter with reference to a time chart shown in FIG. 4 and a flow chart shown in FIG. 5.

Figure 4:
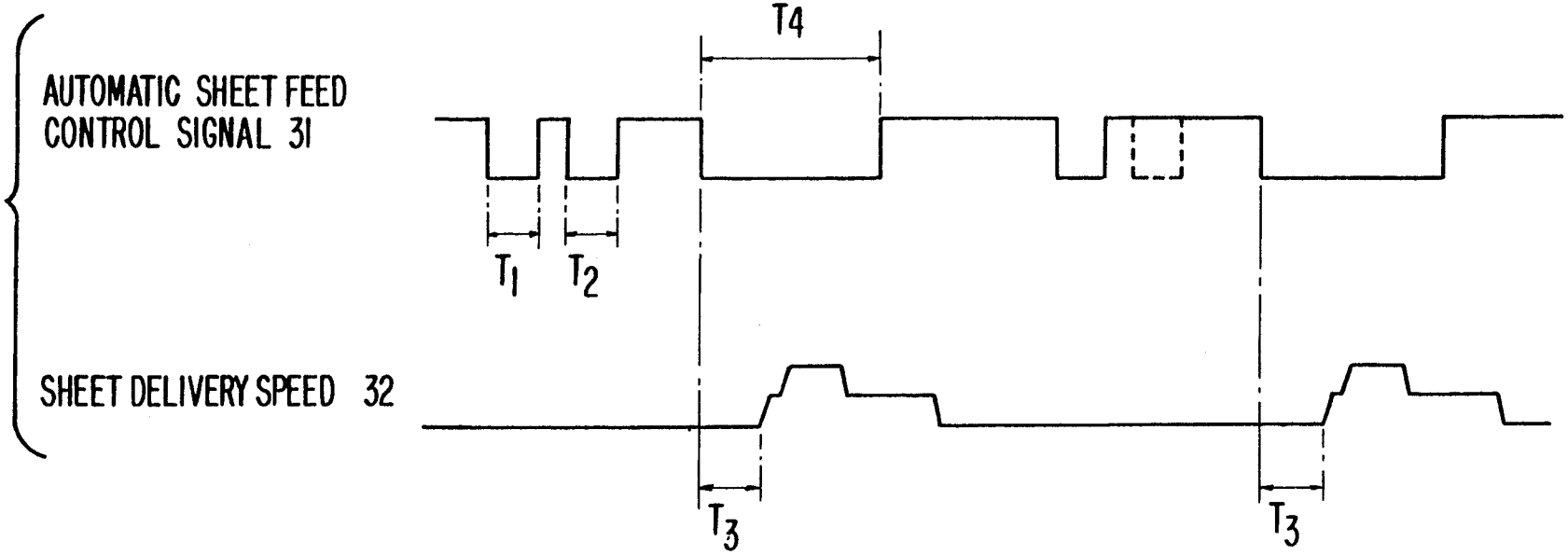
FIG. 4 is a time chart of assistance in explaining a method of controlling the automatic sheet feeder of the present invention.
Figure 5:
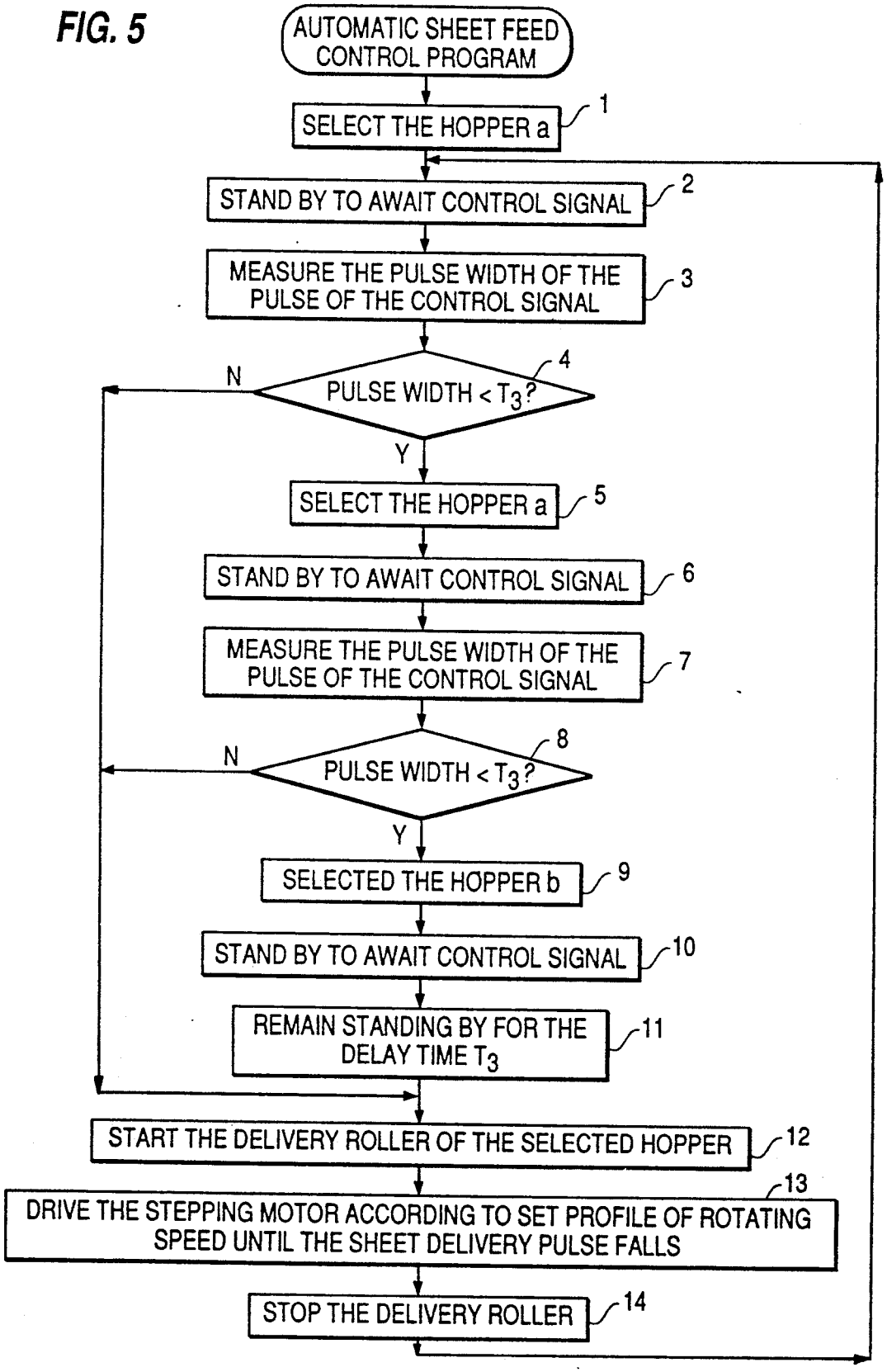
FIG. 5 is a flow chart of a method of controlling the automatic sheet feeder of the present invention.
Figure 6:
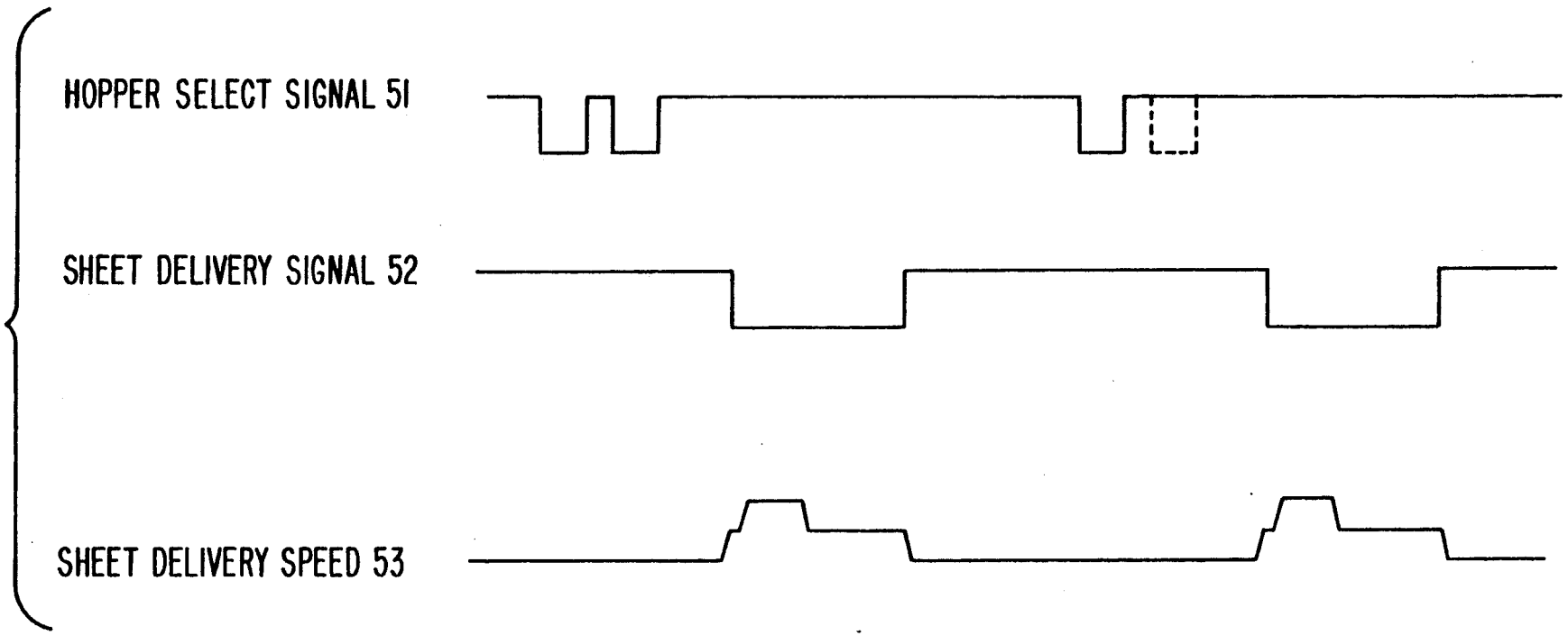
FIG. 6 is a time chart of assistance in explaining a conventional method of controlling an automatic sheet feeder.

Referring to FIG. 4, indicated at 31 is a control signal from the printer to the automatic sheet feeder, and 32 is a graphical representation of the speed at which the sheets 4 or 5 are delivered. $T_1$ and $T_2$ are pulses of the control signal 31 from the printer to the automatic sheet feeder for sheet hopper selection. A pulse $T_4$ in the control signal 31 from the printer to the automatic sheet feeder commands the automatic sheet feeder to deliver the sheets 4 or 5. On the graph 32, $T_3$ is a delay time by which the actuation of the stepping motor 30 is delayed from a moment when the automatic sheet feeder receives a control signal, i.e. pulse $T_4$, commanding the delivery of a sheet 4 or 5.

Upon the reception of the control signal 31 and print data from the host computer, the printer transmits the pulses $T_1$ and $T_2$ to the automatic sheet feeder before transmitting a pulse $T_4$ to the automatic sheet feeder to deliver the sheet 4 or 5. The pulses $T_1$ and $T_2$ need have only the least sufficient widths necessary for sheet hopper selection and are far shorter than the delay time $T_3$.

One of the sheet hoppers a (for example, the sheet hopper 2 in FIG. 1) and b (for example, the sheet hopper 3 in FIG. 1), for example, the sheet hopper a, is selected when only the pulse $T_1$ is applied to the automatic sheet feeder, and the other sheet hopper b is selected when both the pulses $T_1$ and $T_2$ are applied to the automatic sheet feeder.

If the pulse $T_4$ requesting delivery of a sheet is applied to the automatic sheet feeder before applying thereto either pulse $T_1$ or the pulses $T_1$ and $T_2$, the automatic sheet feeder delivers the sheet held by the sheet hopper selected by the preceding hopper select command, or the automatic sheet feeder delivers either the sheet 4 held by the sheet hopper a or the sheet 5 held by the sheet hopper b, specified beforehand as an initial instruction.

The operation of the automatic sheet feeder of the present invention will be described with reference to the flow chart shown in FIG. 5.

Step 1: The CPU 24 selects the sheet hopper a as a default.

Step 2: The automatic sheet feeder stands waiting for control signals.

Step 3: The automatic sheet feeder measures the pulse width of the pulse $T_1$ upon the reception of the pulse $T_1$ from the printer.

Step 4: The CPU 24 makes a query to see if the pulse width of the pulse $T_1$ is not longer than the delay time $T_3$. Step 5 is executed when the response is affirmative or the program jumps to Step 12 when the response is negative.

Step 5: The sheet hopper a is selected. (The default is maintained.)

Step 6: The automatic sheet feeder stands waiting for the reception of the pulse $T_2$ through the signal line 22.

Step 7: The pulse width of the pulse $T_2$ is measured.

Step 8: The CPU 24 makes a query to see if the pulse width of the pulse $T_2$ is not longer than delay time $T_3$. Step 9 is executed when the response is affirmative or the program jumps to Step 12 when the response is negative.

Step 9: The sheet hopper b is selected.

Step 10: The automatic sheet feeder stands waiting for the reception of the pulse $T_4$ through the signal line 22 from the printer.

Step 11: The automatic sheet feeder remains inoperative for the delay time $T_3$ after the reception of the pulse $T_4$.

Step 12: The delivery roller of the selected sheet hopper is actuated to start feeding a sheet.

Step 13: The stepping motor 30 is driven according to a predetermined profile of rotating speed during the duration of the pulse $T_4$.

Step 14: The stepping motor 30 is stopped at the end of the pulse $T_4$ to stop the delivery roller.

The sheet drawn out from the sheet hopper by the delivery roller 6 (or 7) is delivered to the platen 8 by the rollers 15 and 16 (or 17 and 18) rotating in synchronism with the platen 8. Then, the print head 11 prints on the sheet. The sheet is delivered to the stacker 14 after the completion of printing on the sheet.

The present invention is not limited in its application to the foregoing embodiment, but various modifications are possible. The invention may be practiced otherwise than as specifically described above without departing from the spirit and scope of the invention.

For example, the present invention is applicable to controlling an automatic sheet feeder provided with three or more sheet hoppers. When the automatic sheet feeder is provided with a plurality of sheet hoppers, respective pulse signals each having a number of pulses representing each sheet hopper are used, and the selected sheet hopper is identified by the number of pulses included in the pulse signal.

As is apparent from the foregoing description, a method of controlling an automatic sheet feeder in accordance with the present invention uses a single signal line for selecting of a sheet hopper and for initiating the delivery of a sheet. Accordingly, the method of the invention curtails the number of signal lines of the system, simplifies the control of signals, and hence enables the use of an inexpensive automatic sheet feeder.

We claim:

1. A method of controlling an automatic sheet feeder provided with a plurality of sheet hoppers containing sheets, wherein sheets from selected of said sheet hoppers are to be delivered to a printer, said method comprising:

transmitting through a single signal line from said printer to said automatic sheet feeder a control signal including a hopper select signal for selecting a respective said sheet hopper and a sheet delivery signal for delivering a sheet from a selected said sheet hopper;

providing said hopper select signal in the form of one or more pulses and said sheet delivery signal in the form of a pulse having a pulse width greater than the pulse width of said pulse or pulses of said hopper select signal; and identifying each said sheet hopper by a respective number of said pulses of said hopper select signal.

2. A method as claimed in claim 1, wherein said automatic sheet feeder receives said control signal as said hopper select signal when the pulse width of said pulse or pulses from said control signal is less than a predetermined time.

3. A method as claimed in claim 2, wherein said automatic sheet feeder receives said control signal as said sheet delivery signal when the pulse width of the pulse or pulses from said control signal is greater than said predetermined time.

4. A method as claimed in claim 3, comprising commencing delivery of a sheet from the selected sheet hopper after a delay corresponding to said predetermined time from the reception by said automatic sheet feeder of said sheet delivery signal.

5. A method as claimed in claim 3, comprising commencing delivery of a sheet from the selected sheet hopper after a delay corresponding to said predetermined time from the reception by said automatic sheet feeder of said sheet delivery signal.

6. A method as claimed in claim 1, comprising transmitting said hopper select signal to said automatic sheet feeder before transmitting said sheet delivery signal.

7. A method as claimed in claim 1, wherein said automatic sheet feeder receives said control signal as said sheet delivery signal when the pulse width of the pulse or pulses from said control signal is greater than a predetermined time.

* * * * *